US006499625B1

(12) United States Patent
Mendillo et al.

(10) Patent No.: US 6,499,625 B1
(45) Date of Patent: Dec. 31, 2002

(54) ANIMATED FIGURE CANDY DISPENSER

(75) Inventors: James Mendillo, Medford, NJ (US); Tom Watters, Medford Lakes, NJ (US); Donald Amadio, Oaklyn, NJ (US); Chi Kwong Kwan, Kowloon (HK)

(73) Assignee: Oddzon, Inc., Pawtucket, RI (US)

( * ) Notice: Subject to any disclaimer, the term of this patent is extended or adjusted under 35 U.S.C. 154(b) by 0 days.

(21) Appl. No.: 09/873,615

(22) Filed: Jun. 4, 2001

(51) Int. Cl.[7] ..... B65G 59/00

(52) U.S. Cl. ..... 221/24; 221/202; 221/256; 221/266

(58) Field of Search ..... 221/24, 255, 256, 221/263, 266, 202

(56) References Cited

U.S. PATENT DOCUMENTS

| | | | | | |
|---|---|---|---|---|---|
| 616,495 | A | | 12/1898 | Rouillion | |
| 624,354 | A | * | 5/1899 | Lindgren | 221/24 |
| 790,111 | A | | 5/1905 | Crossley | |
| 874,416 | A | * | 12/1907 | Mont | 221/24 |
| 896,263 | A | * | 8/1908 | Aagland | 221/24 |
| D55,885 | S | | 7/1920 | Quinby | |
| 1,354,307 | A | | 9/1920 | Joslin | |
| 1,569,637 | A | | 1/1926 | Snyder | |
| 1,677,041 | A | * | 7/1928 | Mills | 221/256 |
| 1,725,965 | A | | 8/1929 | Ormiston | |
| 1,887,389 | A | | 11/1932 | Adams | |
| 2,117,370 | A | | 5/1938 | Sigg | 312/46 |
| 2,159,356 | A | | 5/1939 | Lambert | 312/76 |
| 2,187,218 | A | * | 1/1940 | Witt | 221/256 |
| 2,256,340 | A | | 9/1941 | Gora et al. | 46/124 |
| 2,514,450 | A | | 7/1950 | Kopf | 46/98 |
| 2,606,088 | A | | 8/1952 | Leaf | 312/89 |
| 2,954,143 | A | * | 9/1960 | Adams | 221/24 |
| 3,313,451 | A | * | 4/1967 | Rhindress | 221/256 |
| 3,660,930 | A | | 5/1972 | Indjian | 46/117 |
| 4,958,746 | A | | 9/1990 | Wu | 221/24 |
| 4,976,376 | A | | 12/1990 | Williams | 221/24 |
| 4,998,644 | A | * | 3/1991 | Pan | 221/24 |
| 5,040,673 | A | | 8/1991 | Huang et al. | 206/214 |
| D342,019 | S | | 12/1993 | Gozzini | D9/310 |
| 5,356,035 | A | | 10/1994 | Shlopak et al. | 222/78 |
| 5,386,909 | A | | 2/1995 | Spector | 206/457 |
| 5,651,475 | A | | 7/1997 | Fenton | 221/24 |
| D386,675 | S | | 11/1997 | Tolpin | D9/310 |
| 5,931,338 | A | | 8/1999 | Hoeting et al. | 221/24 |
| 6,129,608 | A | | 10/2000 | Princhard et al. | 446/475 |

* cited by examiner

*Primary Examiner*—H. Grant Skaggs
(74) *Attorney, Agent, or Firm*—Marshall, Gerstein & Borun

(57) ABSTRACT

A candy dispenser may be provided with a housing shaped like an animated figure and having first and second housing openings formed therein, a candy container operatively positioned relative to the second housing opening so that pieces of candy that are inserted into the second housing opening may pass into the candy container, and a movable animated figure associated with the housing. The movable animated figure may be provided with a candy holder that is sized to hold a piece of candy, and the movable animated figure may be movable between a concealed position in which the movable animated figure is disposed within the housing and a revealed position in which the movable animated figure extends out of the first housing opening. The movable animated figure may be operatively coupled to the candy container so that movement of the animated figure from the revealed position to the concealed position causes a piece of candy to be transferred from the candy container to the candy holder so that the movable animated figure may move from the concealed position to the revealed position with the piece of candy disposed in the candy holder.

21 Claims, 2 Drawing Sheets

ANIMATED FIGURE CANDY DISPENSER

BACKGROUND OF THE INVENTION

The present invention is directed to a candy dispenser for dispensing candy pieces.

Various candy dispensing mechanisms have been marketed in the past to provide entertaining ways of dispensing pieces of candy. For example, one prior art candy dispensing mechanism which was marketed more than one year before the filing of this patent was an M&M® candy dispensing character. That dispensing character had a M&M® candy shaped body, a pair of boots which were attached to a bottom portion of the body, a pair of movable hands and arms that extended outwardly from body, and a cylindrical candy container filled with M&M® candies which mounted onto the body in an inverted position.

In use, after the candy container with the M&M® candies was mounted onto the body in its inverted position, the position of the left hand of the prior art candy dispensing character was manipulated to cause an M&M® candy to be dispensed from the candy container into the right hand of the candy dispensing character. In particular, in response to a user pivoting the left hand, the right hand of the candy dispensing character would be drawn into the body, an M&M® candy would be deposited into the right hand, and then the right hand would move outwardly with the M&M® candy disposed therein.

U.S. Pat. No. 5,386,909 to Spector discloses a display package in the shape of a bear in which a container composed of a clear material is disposed. The container may contain candy pieces, such as "Gummy Bear" candy pieces, and the display package has a viewing port formed therein so that the candy pieces are visible through the container and the viewing port. The candy pieces may be retrieved by unscrewing the cap of the container.

SUMMARY OF THE INVENTION

The invention is directed to a candy dispenser having a housing shaped like an animated figure and having first and second housing openings formed therein, a candy container operatively positioned relative to the second housing opening so that pieces of candy that are inserted into the second housing opening may pass into the candy container, and a movable animated figure associated with the housing. The movable animated figure may be provided with a candy holder that is sized to hold a piece of candy, and the movable animated figure may be movable between a concealed position in which the movable animated figure is disposed within the housing and a revealed position in which the movable animated figure extends out of the first housing opening.

The movable animated figure may be operatively coupled to the candy container so that movement of the animated figure from the revealed position to the concealed position causes a piece of candy to be transferred from the candy container to the candy holder so that the movable animated figure may move from the concealed position to the revealed position with the piece of candy disposed in the candy holder.

The candy dispenser may also include a guide mechanism disposed within the housing that guides movement of the movable animated figure between the concealed position and the revealed position. The guide mechanism may be provided in the form of a pair of guide slots disposed within the housing and a pair of arms associated with the movable animated figure that extend into the guide slots.

The candy container may be pivotable relative to the housing, and the candy container may be operatively coupled to the housing by a pair of pivot pins. Each of the animated figures may be provided with at least a head and a pair of arms. The candy dispenser may also be provided with a spring disposed within the housing, the spring being operatively coupled to the movable animated figure so that the spring biases the movable animated figure to the revealed position.

The features and advantages of the present invention will be apparent to those of ordinary skill in the art in view of the detailed description of the preferred embodiment, which is made with reference to the drawings, a brief description of which is provided below.

DETAILED DESCRIPTION OF VARIOUS EMBODIMENTS

Figure 1:
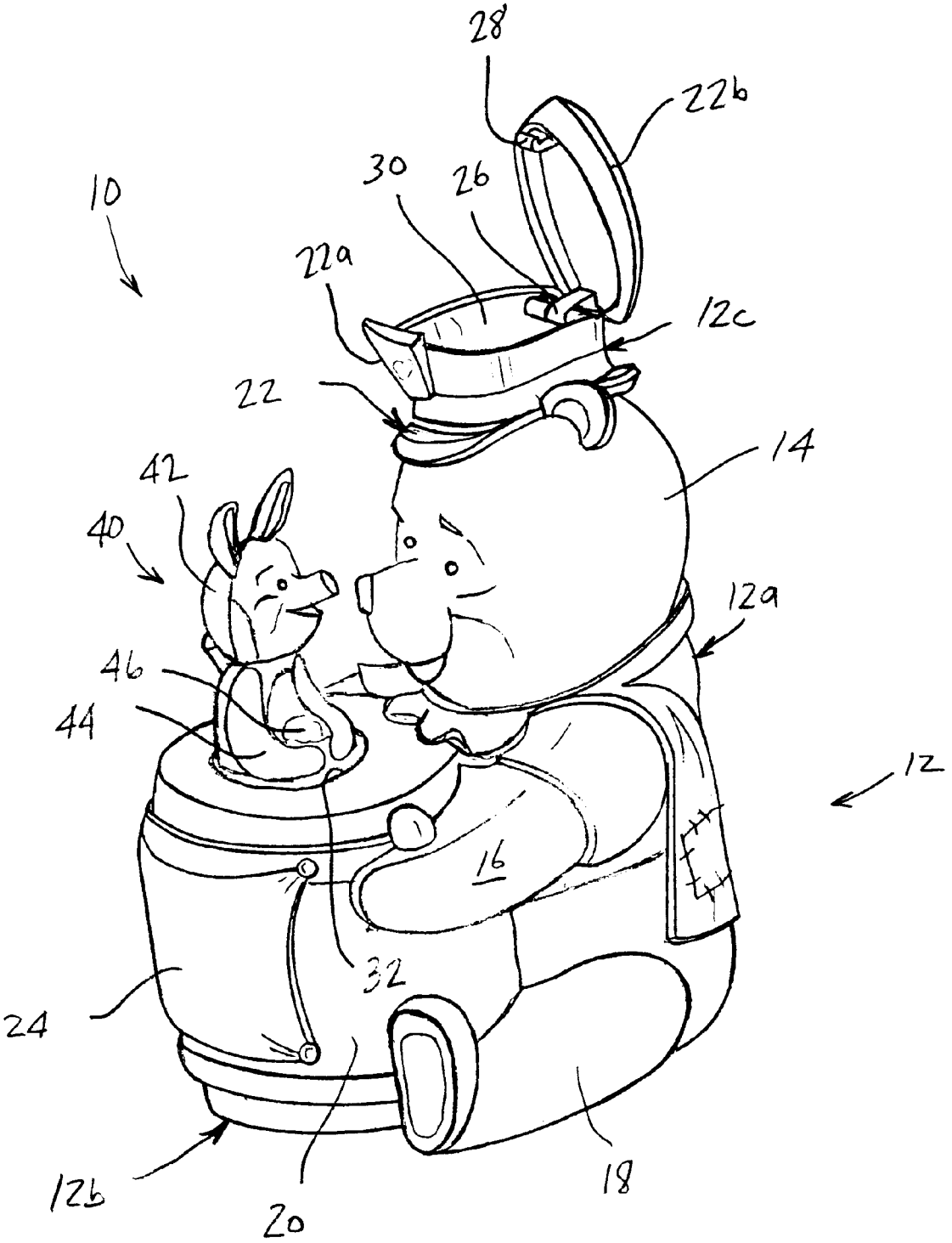
FIG. 1 is a perspective view of one-embodiment of a candy dispenser in accordance with the invention.

FIG. 1 is a perspective view of one possible embodiment of a candy dispenser 10 in accordance with the invention. Referring to FIG. 1, the candy dispenser 10 may be provided with a housing 12 having a first portion 12*a* shaped like an animated figure, such as a bear (e.g. Pooh. bear), having a head 14, a pair of arms 16 and a pair of legs 18, a second housing portion 12*b* shaped like a barrel 20, and a third housing portion shaped like a hat 22. The barrel 20 may be provided with a simulated sign 24 on which a message may be printed, such as "PoohDinis Magik Candy Trik." The first housing portion 12*a* may have other shapes, such as non-animal, humanoid or cartoon figures. The housing 12 may be composed of plastic or other materials, and the housing 12 may be painted or otherwise dyed or colored to emphasize the different features of the housing 12.

The hat 22 may be provided as a bottom hat portion 22*a* integrally formed with the housing 12 and a top hat portion 22*b* that is pivotally-connected to the housing 12 via a hinge 26. The hat 22 may be provided with a latch 28 that latches the top hat portion 22*b* to the bottom hat portion 22*a*. When the top hat portion 22*b* is in an open position, pieces of candy may be inserted into the interior of the housing 12 via an opening 30 formed in the bottom hat portion 22*a* of the housing 12.

The housing portion 12*b* shaped like the barrel 20 may having a hole or opening 32 formed therein, such as in the top of the barrel 20, and an animated figure 40 that is movable relative to the opening 32 may be provided. The movable animated figure 40 may be shaped to correspond to a different type of animal, such as a pig, or may have other shapes, such as non-animal, humanoid or cartoon figures. The animated figure 40 may be provided with at least a head 42 and a pair of arms 44. The animated figure 40 may be movable, such as vertically movable, so that it may be moved between a revealed position in which it extends out of the opening 32 as shown in FIG. 1 and a concealed position in which it is disposed at least partially within the opening 32 and in which the movable figure 40 is at least partially concealed from view.

The movable animated figure 40 may be provided with a candy holding portion or candy holder 46, that may-be provided as a depression, such as a curved or bowl-shaped depression, which may be an integrally formed portion of the animated figure 40. As described below, the candy dispenser 10 may be designed so that when the animated figure 40 is pushed downwardly from its revealed position to its concealed position and then released, the animated figure 40 automatically comes back up to its revealed position with a piece of candy disposed in the candy holder 46.

Figure 2:
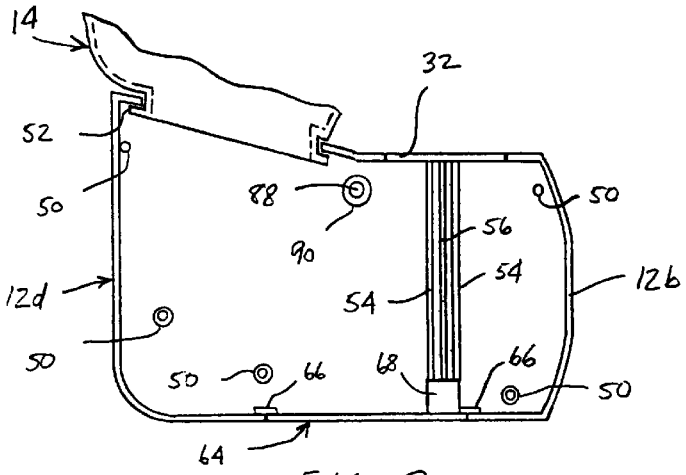
FIG. 2 is a side view of a portion of the interior of the candy dispenser of FIG. 1 with several components not shown.

Referring to FIG. 2, which illustrates a portion of the candy dispenser 10 in unassembled form, the housing 12 may include a pair of lower housing sections 12*d*, one of which is shown. The two lower housing sections 12*d* may be fastened together via a plurality of connecting posts 50 integrally formed with the housing sections 12*d*, with each of the connecting posts 50 being joined to a respective connective post 50 on the opposite housing section 12*d* to join the housing sections 12*d* together.

The head 14 of the housing 12 may be provided as a separate piece which may be captured within a generally circular aperture formed when the two housing sections 12*d* are joined together and which may be retained within the circular aperture by a lower lip 52 having a diameter larger than that of the circular aperture. Alternatively, the head 14 of the housing 12 may be integrally formed with the housing sections 12*d*.

Figure 2A:
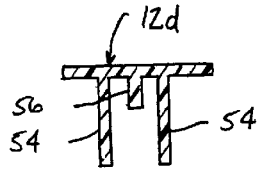
FIG. 2A is a cross-sectional top view of a portion of a housing section.

The interior of each housing section 12*d* may be provided with a pair of vertically disposed, spaced-apart guide walls 54 and a third, vertically disposed wall member 56 disposed between the guide walls 54. The two guide walls 54 attached to each housing section 12*d* may be spaced apart to define a guide slot that receives one of a pair of guide members or arms 58, 60 (see FIGS. 3 and 4) integrally formed with or otherwise attached to a cylindrical base member 62 that may support the movable animated figure 40. As shown in FIG. 2A, which is a cross-sectional top view, the guide walls 54 may extend outwardly farther than the guide member 56.

When connected together, a rectangular aperture may be formed in the bottom of the lower housing sections 12*d* and a rectangular plate 64 may be provided to close the rectangular aperture. The rectangular plate 64 may be provided with one or more retaining members 66 that retain the plate 64 in place. The rectangular plate 64 may be provided as a non-removable plate which is permanently fixed to close the opening. In such case, the rectangular plate 64 may be positioned within the opening when the two lower housing sections 12*d* are fixed together.

Figure 3:
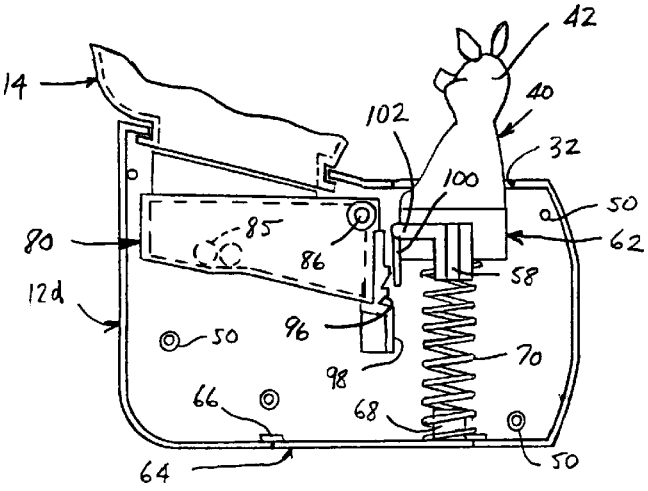
FIG. 3 is a side view of a portion of the interior of the candy dispenser and the internal components disposed therein.

FIG. 3 illustrates the same lower housing section 12*d* as shown in FIG. 2, and FIG. 3 also illustrates the internal components of the candy dispenser 10 that are disposed within the lower housing sections 12*d* when they are connected together. Referring to FIGS. 2 and 3, a lower spring retaining post 68, which may be cylindrically shaped, may be provided on the bottom of the housing 12 directly below the base member 62 so that a spring 70 may be used to support the base member 62.

Figure 4:
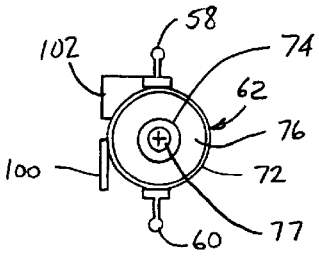
FIG. 4 is a bottom view of a movable base member of the candy dispenser.

FIG. 4 is a bottom view of the base member 62 that supports the movable animated figure 40. Referring to FIG. 4, the underside of the base member 62 may have an outer annular wall 72, a centrally disposed spring retaining post 74, and an annular recess 76 disposed between the outer annular wall 72 and the spring retaining post 74. The movable animated figure 40 may be fixed to the base member 62 by a screw 77 that passes through the spring retaining post 74 and into the bottom portion of the movable animated figure 40. Alternatively, the movable animated figure 40 could be integrally formed with the base member 62.

Referring to FIGS. 2–4, when the candy dispenser 10 is fully assembled, the two guide arms 58, 60 of the base member 62 are disposed within the two guide slots formed between the four guide walls 54, and the spring 70 supports the base member 62, with the lower end of the spring 70 being disposed around the lower retaining post 68 and the upper end of the spring 70 being disposed within the annular recess 76 formed in the underside of the base member 62 and around the spring retaining post 74. When so assembled, the movable animated figure 40 is vertically movable and may be pushed downwardly, against the force of the spring 70, so that it moves between its revealed and concealed positions described above.

The ends of the guide arms 58, 60 may make contact with the central wall member 56. (FIG. 2A), and the central wall member 56 may be provided with a straight contact surface (while the housing wall to which it is attached may have an irregularly shaped surface) so as to ensure smooth linear movement of the animated figure 40.

Figure 5A:
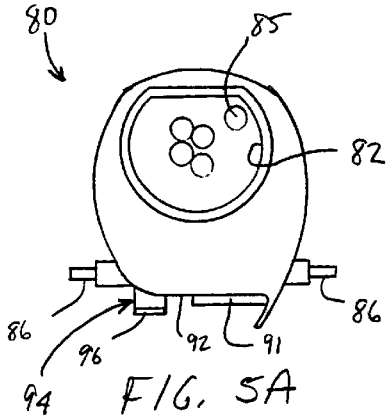
FIG. 5A is a top view of a candy container disposed within the candy dispenser.
Figure 5B:
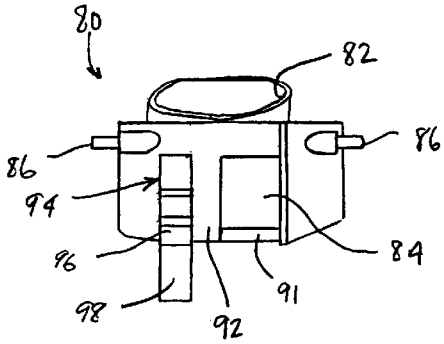
FIG. 5B is a side view of the candy container of FIG. 5A.

As shown in FIG. 3, when the candy dispenser 10 is assembled, the interior of the housing 12 may be provided with a candy container 80. FIG. 5A is a top view of the candy container 80, and FIG. 5B is a front view of the, container 80. Referring to FIGS. 2, 5A and 5B, the candy container 80 may be provided with a top opening 82, which may be generally circular in shape, and a side or front dispensing opening 84, which may be generally rectangular in shape.

The candy container 80 may be positioned within the interior of the housing 12 so that the top opening 82 is positioned so that candy pieces 85 that are dropped through the opening 30 (FIG. 1) formed in the hat 22 fall through the top container opening 82 and into the container 80. The candy pieces 85 may be spherical or generally spherical in shape. The candy container 80 may be formed integrally with the housing 12, or may be provided as a separate piece, as shown in FIGS. 3, 5A and 5B. If provided as a separate piece, the candy container 80 may be either fixed or movable relative to the housing 12.

If the container 80 is movable relative to the housing 12, the container 80 may be pivotally connected to the housing sections 12*d* via a pair of pivot pins 86 which extend from the sides of the container 80. Each of the pivot pins 86 may be received into a respective hole 88 disposed in a respective one of two support members 90, each of which may be integrally formed with or otherwise attached to one of the housing sections 12*d*.

Referring to FIGS. 3, 5A and 5B, the candy container 80 may be provided with a member or ledge 91 that extends outwardly beyond a front face 92 of the candy container 80.

The candy container 80 may also be provided with a container positioning member 94. The positioning member 94, which may have numerous different shapes, may have an upper portion with a pair of extending portions 96 each of which may be generally shaped like a sawtooth having a slightly flattened point and a lower portion that may include a vertically disposed, flat plate 98.

As shown in FIGS. 3 and 4, the base member 62 that supports the movable animated figure 40 may be provided with a member or trigger 100, which may be rectangularly shaped and which may extend horizontally at least slightly outwardly relative to the annular wall 72 and vertically below the annular wall 72. The base member 62 may also be provided with a positioning member 102. The trigger 100 and the positioning member 102 could have many different shapes.

Referring to FIG. 3, the trigger 100 may be generally aligned and provided to face towards the ledge 91 so that when the animated figure 40 is pushed downwardly, the trigger 100 will make physical contact with the ledge 91 and cause the candy container 80 to pivot or rock slightly away (clockwise in FIG. 3) from the animated figure 40. Such rocking or pivoting motion of the candy container 80 may cause a candy piece 85 to move downwardly along the angled bottom of the candy container 80 and into the candy holder 46 (FIG. 1).

Upon further downward movement of the animated figure 40, the positioning member 102 of the base member 62 may make contact with the positioning member 94 of the candy container 80. The positioning members 94, 102 may be designed so that their abutment or contact causes the candy container 80 to be held in a slightly pivoted position as long as the movable animated figure 40 and base member 62 occupy a relatively low position, e.g. the vertical position of the base member 62 at which the trigger 100 of the base member 62 lies at an elevation below that of the ledge 91 of the candy container 80. In that case, upward movement of the animated figure 40 and base member 62 will not be impeded or prevented due to the trigger 100 making physical contact with the ledge 91.

As the animated figure 40 and base member 62 move further upwards, the trigger 100 will not make contact with the ledge 91 and the positioning member 102 of the base member 62 will not make contact with the positioning member 94 of the candy container 80, thus allowing the candy container 80 to pivot, under the influence of gravity, back to its original position.

In summary, the internal components of the candy dispenser 10 may be designed to allow the movable animated figure 40 to be pushed downwardly so that a portion of the animated figure 40 or a portion of a base member 62 to which it is attached makes physical contact with the candy container 80 to cause it to move from an original position to a pivoted position, so that the candy container 80 remains in its pivoted position as long as the animated figure 40 is below a certain vertical position, and so that the candy container 80 moves back to its original position when the animated figure 40 moves upwardly past a certain elevation.

Although the movable animated figure 40 is described above as moving vertically, it could be moved in other directions. Instead of the movable animated figure 40 being forced upwardly by a spring, its movement could be automated, such as by use of an electric motor.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A candy dispenser, comprising:

a housing having a hollow interior portion and comprising:

a first housing portion shaped like a bear;

a second housing portion shaped like a barrel and having a first housing opening formed therein;

a third housing portion shaped like a hat and having a second housing opening formed therein, at least a portion of said third housing portion being movable between an open position in which a plurality of pieces of candy may be inserted into said second housing opening and a closed position in which said third housing portion closes said second housing opening;

a candy container disposed in said hollow interior portion of said housing, said candy container comprising a first container opening operatively positioned relative to said second housing opening so that pieces of candy that are inserted into said second housing opening will fall into said candy container through said first container opening and a second container opening, said candy container being movable between a first position and a second position;

a movable animated figure associated with said second housing portion, said movable animated figure having a candy holder that is sized to hold a piece of candy, said movable animated figure having at least a head and a pair of arms and being vertically movable between a concealed position in which said movable animated figure is disposed within said second housing portion and a revealed position in which said movable animated figure extends out of said first housing opening;

a guide mechanism disposed within said housing that guides movement of said movable animated figure between said concealed position and said revealed position; and a spring disposed within said housing, said spring being operatively coupled to said movable animated figure so that said spring biases said movable animated figure to said revealed position, said movable animated figure having a trigger portion that makes physical contact with a portion of said candy container when said movable animated figure is pushed from said revealed position to said concealed position, said physical contact between said trigger portion and said candy container portion causing said candy container to move and causing a piece of candy to be transferred through said second container opening to said candy holder so that when said movable animated figure is released, said movable animated figure will move upwardly from said concealed position to said revealed position with said piece of candy disposed in said candy holder.

2. A candy dispenser as defined in claim 1 wherein said movable animated figure is shaped like a portion of a pig.

3. A candy dispenser as defined in claim 1 wherein said guide mechanism comprises a pair of guide slots disposed within said housing and a pair of arms associated with said movable animated figure that extend into said guide slots.

4. A candy dispenser as defined in claim 1 wherein said candy container is pivotable relative to said housing.

5. A candy dispenser as defined in claim 1 wherein said candy container is pivotable and wherein said candy container is operatively coupled to said housing by a pair of pivot pins.

6. A candy dispenser, comprising:

a housing having a hollow interior portion and being shaped like an animated figure having at least a head, said housing having a first housing opening formed therein and a second housing opening formed therein, said housing having a movable housing portion that is movable between an open position in which a plurality of pieces of candy may be inserted into said second housing opening and a closed position in which said movable housing portion closes said second housing opening;

a candy container disposed in said hollow interior portion of said housing, said candy container comprising a first container opening operatively positioned relative to said second housing opening so that pieces of candy that are inserted into said second housing opening will fall into said candy container through said first container opening and a second container opening, said candy container being movable between a first position and a second position;

a movable animated figure associated with said housing, said movable animated figure having a candy holder that is sized to hold a piece of candy, said movable animated figure having at least a head and a pair of arms and being vertically movable between a concealed position in which said movable animated figure is disposed within said housing and a revealed position in which said movable animated figure extends out of said first housing opening;

a guide mechanism disposed within said housing that guides movement of said movable animated figure between said concealed position and said revealed position; and a spring disposed within said housing, said spring being operatively coupled to said movable animated figure so that said spring biases said movable animated figure to said revealed position, said movable animated figure having a trigger portion that makes physical contact with a portion of said candy container when said movable animated figure is pushed from said revealed position to said concealed position, said physical contact between said trigger portion and said candy container portion causing said candy container to move and causing a piece of candy to be transferred through said second container opening to said candy holder so that when said movable animated figure is released, said movable animated figure will move upwardly from said concealed position to said revealed position with said piece of candy disposed in said candy holder.

7. A candy dispenser as defined in claim 6 wherein said guide mechanism comprises a pair of guide slots disposed within said housing and a pair of arms associated with said movable animated figure that extend into said guide slots.

8. A candy dispenser as defined in claim 6 wherein said candy container is pivotable relative to said housing.

9. A candy dispenser as defined in claim 6 wherein said candy container is pivotable and wherein said candy container is operatively coupled to said housing by a pair of pivot pins.

10. A candy dispenser, comprising:

a housing having a hollow interior portion, a first housing opening formed therein and a second housing opening formed therein;

a candy container disposed in said hollow interior portion of said housing, said candy container comprising a first container opening operatively positioned relative to said second housing opening so that pieces of candy that are inserted into said second housing opening will fall into said candy container through said first container opening and a second container opening, said candy container being movable between a first position and a second position;

a movable animated figure associated with said housing, said movable animated figure having a candy holder that is sized to hold a piece of candy, said movable animated figure having at least a head and a pair of arms and being movable between a concealed position in which said movable animated figure is disposed within said housing and a revealed position in which said movable animated figure extends out of said first housing opening; and a guide mechanism disposed within said housing that guides movement of said movable animated figure between said concealed position and said revealed position, said movable animated figure having a portion that makes physical contact with a portion of said candy container when said movable animated figure moves from said revealed position to said concealed position, said physical contact between said portion of said movable animated figure and said candy container portion causing said candy container to move and causing a piece of candy to be transferred through said second container opening to said candy holder.

11. A candy dispenser as defined in claim 10 wherein said candy container is pivotable relative to said housing.

12. A candy dispenser as defined in claim 10 wherein said candy container is pivotable and wherein said candy container is operatively coupled to said housing by a pair of pivot pins.

13. A candy dispenser as defined in claim 10 additionally comprising a spring disposed within said housing, said spring being operatively coupled to said movable animated figure so that said spring biases said movable animated figure to said revealed position.

14. A candy dispenser, comprising:

a housing having a hollow interior portion;

a candy container disposed in said hollow interior portion of said housing, said candy container comprising a first container opening through which pieces of candy may be inserted and a second container opening, said candy container being movable between a first position and a second position;

a movable animated figure associated with said housing, said movable animated figure having a candy holder that is sized to hold a piece of candy, said movable animated figure being movable between a concealed position in which said movable animated figure is disposed within said housing and a revealed position in which said movable animated figure extends out of said housing; and a guide mechanism disposed within said housing that guides movement of said movable animated figure between said concealed position and said revealed position, said movable animated figure having a portion that makes physical contact with a portion of said candy container when said movable animated figure moves from said revealed position to said concealed position, said physical contact between said portion of said movable animated figure and said candy container portion causing said candy container to move and causing a piece of candy to be transferred through said second container opening to said candy holder.

15. A candy dispenser as defined in claim 14 wherein said candy container is pivotable relative to said housing.

16. A candy dispenser as defined in claim 14 wherein said candy container is pivotable and wherein said candy container is operatively coupled to said housing by a pair of pivot pins.

17. A candy dispenser as defined in claim 14 additionally comprising a spring disposed within said housing, said spring being operatively coupled to said movable animated figure so that said spring biases said movable animated figure to said revealed position.

18. A candy dispenser, comprising:

a housing having a hollow interior portion;

a candy container disposed in said hollow interior portion of said housing, said candy container comprising a container opening through which pieces of candy may be inserted, said candy container being movable relative to said housing between a first position and a second position;

a movable animated figure associated with said housing, said movable animated figure having a candy holder that is sized to hold a piece of candy, said movable animated figure being movable between a concealed position in which said movable animated figure is disposed within said housing and a revealed position in which said movable animated figure extends out of said housing; and a guide mechanism disposed within said housing that guides movement of said movable animated figure between said concealed position and said revealed position, said movable animated figure having a portion that makes physical contact with a portion of said candy container when said movable animated figure moves from said revealed position to said concealed position, said physical contact between said portion of said movable animated figure and said candy container portion causing said candy container to move and causing a piece of candy to be transferred through said container opening to said candy holder.

19. A candy dispenser as defined in claim 18 wherein said candy container is pivotable relative to said housing.

20. A candy dispenser as defined in claim 18 wherein said candy container is pivotable and wherein said candy container is operatively coupled to said housing by a pair of pivot pins.

21. A candy dispenser as defined in claim 18 additionally comprising a spring disposed within said housing, said spring being operatively coupled to said movable animated figure so that said spring biases said movable animated figure to said revealed position.

* * * * *